US006854734B1

(12) United States Patent
Benjamin

(10) Patent No.: US 6,854,734 B1
(45) Date of Patent: Feb. 15, 2005

(54) LIMBO GAME

(76) Inventor: Gregory Benjamin, 333 McKenzie Dr., Stockbridge, GA (US) 30281

( * ) Notice: Subject to any disclaimer, the term of this patent is extended or adjusted under 35 U.S.C. 154(b) by 359 days.

(21) Appl. No.: 10/140,874

(22) Filed: May 9, 2002

Related U.S. Application Data

(60) Provisional application No. 60/289,827, filed on May 10, 2001.

(51) Int. Cl.[7] ..... A63B 67/00
(52) U.S. Cl. ..... 273/449; 273/440
(58) Field of Search ..... 273/449, 440, 273/459; 181/148, 156, 153

(56) References Cited

U.S. PATENT DOCUMENTS 3,294,400 A 12/1966 Goldstein ..... 273/1
3,801,096 A * 4/1974 Miller ..... 273/449
5,120,077 A 6/1992 Belli ..... 273/444
5,450,495 A * 9/1995 Goldfarb ..... 381/89
5,622,370 A 4/1997 D'Andrade ..... 273/449
5,674,076 A * 10/1997 Billings et al. ..... 434/365

* cited by examiner

*Primary Examiner*—Derris H. Banks
*Assistant Examiner*—Alex F. R. P. Rada, II
(74) *Attorney, Agent, or Firm*—Patent & Trademark Services, INC; Joseph H. McGlynn; Thomas Zack

(57) ABSTRACT

An apparatus for playing the limbo game that has either battery operated speakers in the bar, which can play music, or the bar may have a speaker outlet through which an outside source of music can be played.

4 Claims, 2 Drawing Sheets

LIMBO GAME

This invention claims the benefit of the U.S. Provisional application No. 60/289,827 filed on May 10, 2001.

BACKGROUND OF THE INVENTION

The present invention relates to a portable game used to play limbo.

The game of limbo is well known. In the most basic form, two people hold a bar above the ground or other surface while the player bends backwards to advance under the bar. By progressively lowering the bar, individual players will eventually not be able to go under the bar. The last player to go under the lowest bar is declared the winner. To unsure uniformity in the height of the bar, stands with bar holders may be used in place of the people holding the bar.

DESCRIPTION OF THE PRIOR ART

Limbo bars with supporting end posts, or uprights, are disclosed in a variety of configurations and sizes in the prior art. For example, U.S. Pat. No. 3,294,400 to Goldstein discloses spaced uprights used to hold a rod above the ground. Engergizable indicators (lights), on at least one of the uprights, are responsive to a circuit to energize the lights when a bar is placed in a holder on the upright.

U.S. Pat. No. 3,801,096 to Miller discloses a limbo game apparatus with uprights formed of plastic tubing and split lengthwise. A piece of doweling is inserted in the split of each upright. Graduations in the uprights insure the operator places the dowel pins at the same height.

U.S. Pat. No. 5,120,077 to Belli discloses a game device with a horizontal stream of water which can be raised or lowered on a supporting upright and which is used as a barrier to pass under.

U.S. Pat. No. 5,622,370 to D'Andrade discloses a limbo bar device with bases for supporting vertical poles and a water distribution and spraying unit on a mechanism which has vertical height adjustments. A limbo bar is rotatably connected to the water distribution system which gets the player wet when moved.

In the present invention a bar, used in a limbo game, has battery operated speakers which can play music, or the bar can have a speaker outlet through which an outside source of music can be played. The bar is held at different heights by telescoping or screwing together supports, all as will be detailed in the specification that follows hereafter.

SUMMARY OF THE INVENTION

This invention relates to a limbo game that has either, battery operated speakers in the bar which can play music, or the bar may have a speaker outlet through which an outside source of music can be played.

It is the primary object of the present invention to provide for an improved limbo game having a bar which emits sounds of music.

Another object is to provide for such a game wherein audio sounds may be emitted from a speaker in the bar, or from a speaker outlet in the bar that receives music from an outside source.

These and other objects and advantages of the present invention will become apparent to readers from a consideration of the ensuing description and the accompanying drawings.

DESCRIPTION OF THE PREFERRED EMBODIMENT

Figure 1:
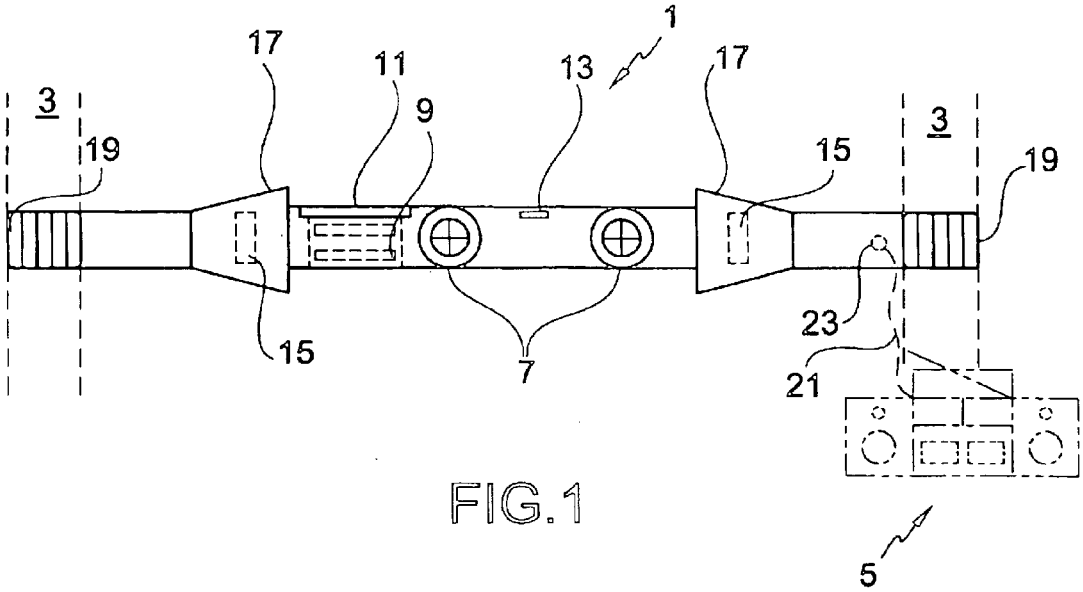
FIG. 1 is a front view of the bar of the present invention, with the speakers incorporated in the bar which also has provision for an optional outside source of music.

FIG. 1 is a front view of the bar 1 of the present invention supported by two end uprights 3, shown partially in dotted line format. The bar 1 may have speakers 7, either incorporated in the bar, or may have an optional outside source of music, as shown in dotted line format, such as the conventional cassette/cd/radio 5, that supply music to the bar. When the speakers 7 are incorporated into the internal volume of the structure of the bar 1, they would be electrically connected to a self contained power source such as a battery source 9 in the bar which source is accessible from a door 11 on the surface of the bar 1. An external power control button 13 permits the user to actuate conventional electronic components 15, also within the bar, that are powered by the battery 9 and provide for the sending of signals to the speakers 7.

The same door 11 may be used to introduce external sources of music into the electronic components 15 to play the same on the audio speakers 7. Clearly, the size of the recorded music sources used would have to be such that it could be accommodated within the dimension of the bar, which typically would be about 2 inches in diameter. Mini cassettes or mini compact discs could be used for this purpose. In addition, a small am/fm radio could be incorporated into the bar at location 15 with external controls at power button location 13.

Protective outstanding flared portions 17, extending past the diameter of the bar 1, are placed along the bar to insure that the conventional insulated internal electronic and electrical components will have further protection and not become damaged when the bar strikes the ground. The two opposite end portions 19 of the bar may have rubber or plastic coverings to insure a good fit with the bar holders shown in FIG. 4.

In the optional method of supplying music to the bar, shown by the combined conventional cassette/cd/radio 5, shown in dotted line format, a power line 21 is connected to a speaker outlet 23, shown in dotted line format in FIG. 1, located in the structure of the bar 1. The music reproduced on the unit 5 is sent to the outlet of the bar where it can be heard by a player as he/she passes under the bar. Either of the two methods, of supplying music to the bar, may be used, the one incorporating an audio system into the bar or the one using a remote audio system, may be used separately or, if desired, both could be incorporated into the same bar as depicted.

Figure 2:
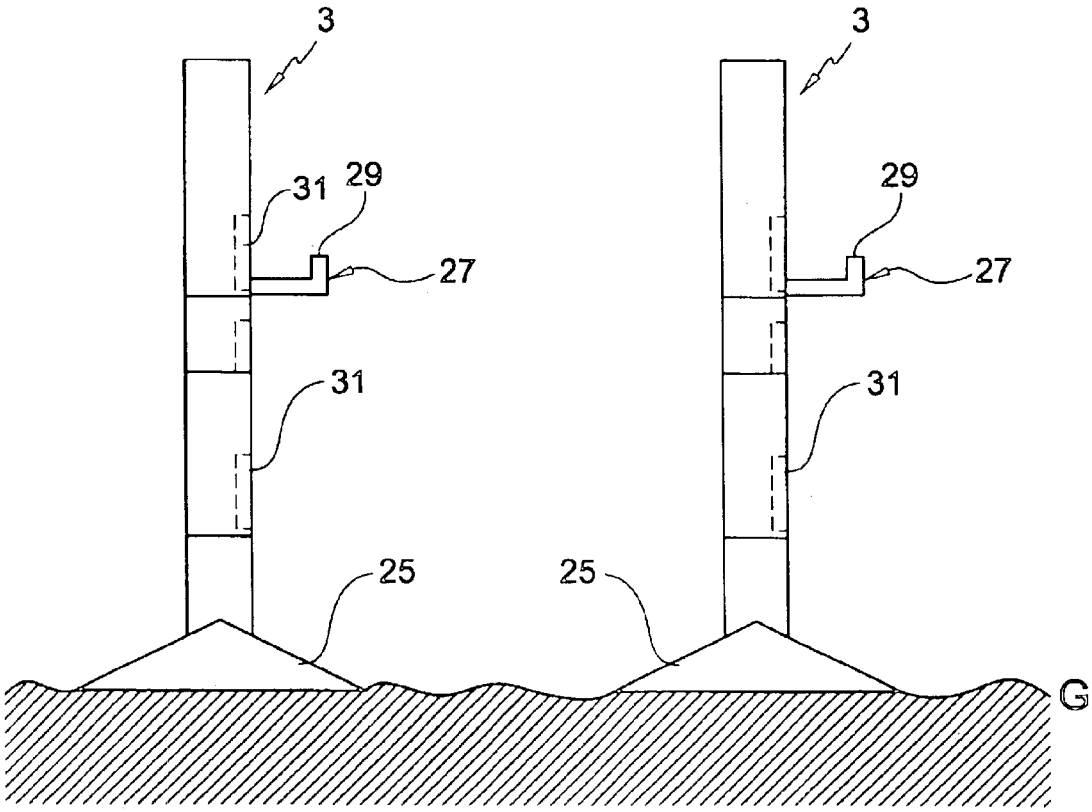
FIG. 2 is a front view of the two supporting uprights used to support the bar of FIG. 1.
Figure 3:
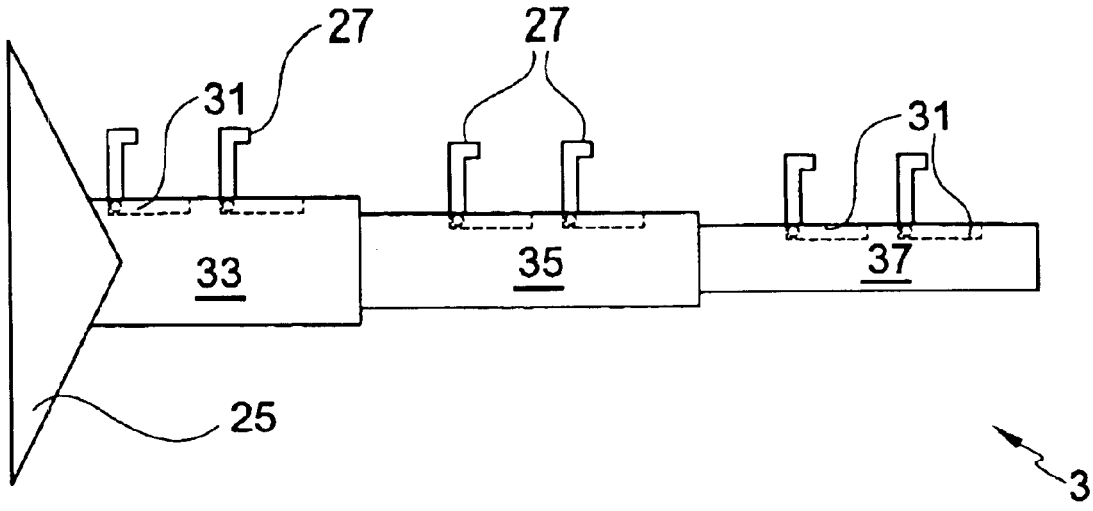
FIG. 3 is a side view of one of the FIG. 2 uprights, showing it in a prone position.

FIG. 2 is a front view of the two supporting uprights 3 used to support the bar 1 of FIG. 1 in a vertical position at its two ends. Both uprights are substantially identical in size and shape. Each has a lower enlarged base 25 that rests on the ground G. Each upright has slots 31 spaced along their height. The slots 31 house the individual bar holders 27, shown in FIG. 4, with one holder to each slot. When the holders 27 are placed in a retracted position, the bar holders 27 are pivoted into a position within the slots 31. When in an extended position, the holders 27 provide a resting surface for the bar 1. The holders 27 have a vertically disposed lip 29 that retains the bar 1 between the lip 29 and the vertical upright 3 until a player pushes it from the supported position. The slots 31 are molded into the uprights 3 and provide a surface for the hinged bar bolder 27 to be attached thereto. As shown in FIG. 3, the slots 31 are spaced along the height or length of the uprights 3, starting just above the base and extending to near the top surface of the upright.

The uprights 3 may be constructed of aligned sections that telescope together or may be made of sections that screwed into each together.

FIG. 3 is a side view of one of the FIG. 2 uprights 3 showing it in a prone position. In this embodiment, there are three joined sections 33, 35 and 37 to the upright 3 with each section having two slots 31 and each slot having a hinged bar holder 27. All of the six bar holders are shown in their extended bar receiving positions. When retracted into the body of the upright, the retracted holders form a smooth continuous outer surface on the uprights to permit them to be transported or stored, as desired. In this particular embodiment, the three sections are telescopingly joined together and may be moved to the extended position by retracting all of the bar holders and then pulling the two upper sections (35, 37) away from the base 25. A screw rod, within the sections, could also be used to extend and retract the sections relative to each other.

Figure 4:
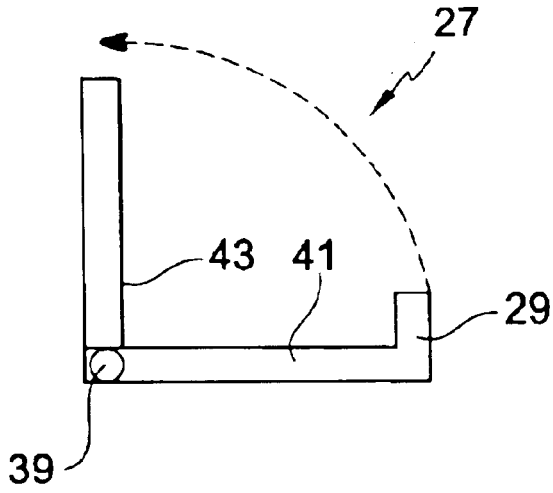
FIG. 4 is an enlarged side view of one of the bar holders used in the present invention.

FIG. 4 is an enlarged side view of one of the bar holders 27. A hinge 39 joins the leg 41 to a smaller leg 43, which is within the slot 31. The position of the holder, shown in FIG. 4, is the extended position. When retracted into the body of the upright, as shown by the dotted lines, the lip 29 pivots and moves to position just past the end of the fixed leg 43.

Many material can be used to construct the components described. This includes plastics, such as polystyrene for the bar and much of the uprights, and synthetic rubber for the base 25 and the ends 19 of the bar. Typically, the cassette or CD used has Caribbean music playing while the players try to go under the bar. Colors such as red, white and blue could be used for the different components. In one embodiment, the uprights were 6 feet in length and the bar 4 feet. The base had a diameter of 10 inches while the diameter of the bar was 2 inches. The sections of the uprights were of different lengths starting at the bottom 33, or base, at 28 inches, then 21 inches for middle section 35 with 9 inches for the top section 37. It should be noted that these dimensions are merely for illustrational purposes and other dimensions could be used without departing from the scope of the invention.

When telescoped into each other the diameters of the sections would decease from base to top to allow room to slide them together. Other modifications are also possible depending on the particular options shown for the audio units and the uprights.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A game apparatus for playing limbo comprising:

a first upright, a second upright spaced from said first upright, a bar interconnecting said first upright to said second upright, said bar having an internal volume to receive a sound source, a sound source with speakers within the internal volume of said bar to emit sound to a listener, said sound source also including a self contained power source in the bar and a power control member on the bar, and a door on the bar to permit access into the internal volume of the bar and to introduce recorded sound sources into electronic components located within the bar, said recorded sound source emitting sound in the form of music to the speakers.

2. The game apparatus as claimed in claim 1, wherein said bar has a diameter that is approximately two inches, and the recorded sound sources consist of a mini compact disc that is no larger than 2 inches in diameter that plays limbo music.

3. A game apparatus for playing limbo comprising:

a first upright, a second upright spaced from said first upright, a bar interconnecting said first upright to said second upright, said bar having a diameter and length, said bar having an internal volume to receive a sound source, a sound source in the internal volume of said bar to emit sound to a listener, and multiple protective portions mounted along the length of said bar and extending outwardly from the diameter of the bar on both sides of the sound source.

4. The game apparatus of claim 3 wherein;

said multiple protective portions comprise to two spaced protective members with flared portions.

* * * * *